US005255919A

United States Patent [19]

Johnson

[11] Patent Number: 5,255,919

[45] Date of Patent: Oct. 26, 1993

[54] GOLF PUTTER

[76] Inventor: Alexander T. Johnson, 25 Hillview Rd., North Balwyn, Victoria, 3104, Australia

[21] Appl. No.: 723,450

[22] Filed: Jun. 28, 1991

Related U.S. Application Data

[62] Division of Ser. No. 643,413, Jan. 18, 1991, Pat. No. 5,116,054.

[30] Foreign Application Priority Data

Aug. 21, 1990 [AU] Australia ..... PK 1854/90

[51] Int. Cl.[5] ..... A63B 53/04

[52] U.S. Cl. ..... 273/168; 273/80.2

[58] Field of Search ..... 273/169, 168, 80 A, 273/162, 164, 80.2

[56] References Cited

U.S. PATENT DOCUMENTS

| | | | |
|---|---|---|---|
| 786,268 | 4/1905 | Corey et al. | 273/168 |
| 1,171,806 | 2/1916 | Scott | 273/80.2 |
| 2,231,847 | 2/1941 | Dickson et al. | 273/80 A |
| 2,926,913 | 3/1960 | Stecher | 273/168 X |
| 3,081,087 | 3/1963 | Redd | 273/168 X |
| 3,194,564 | 7/1965 | Swan | 273/168 X |
| 3,199,872 | 8/1965 | Taylor | 273/168 X |
| 4,592,552 | 6/1986 | Garber | 273/168 |
| 5,116,054 | 5/1992 | Johnson | 273/164.1 |

FOREIGN PATENT DOCUMENTS

| | | |
|---|---|---|
| 449540 | 5/1973 | Australia . |
| 466553 | 3/1974 | Australia . |
| 7579360 | 3/1975 | Australia . |
| 14608 | 6/1904 | United Kingdom . |
| 382046 | 10/1932 | United Kingdom . |
| 739403 | 10/1955 | United Kingdom . |

OTHER PUBLICATIONS

Par Golf Mfg Co., 1964 Golf Supplies, p. 35, top, club head no. 1300.

Golf Digest, Jan., 1982, p. 93, club head no. 27.

*Primary Examiner*—George J. Marlo

*Attorney, Agent, or Firm*—Harness, Dickey & Pierce

[57] ABSTRACT

A blade type golf putter having a putter head which includes an integral hosel for mounting the head on one end of a shaft, the putter including two ball striking faces, the hosel being shaped such that the axis of the shaft passes through a mid point on a straight line passing through the centers or centroids of the sweet spots of the two ball striking faces of the putter and further the hosel has an elongate base which merges into the top face of the head by two concave generally cylindrical surfaces which are polished so that light reflected therefrom towards the user of the putter appears as lines which are parallel to top edges of the blade. The first, shaft engaging portion of the hosel is located between the center and heel end of the putter head, and has a substantially lesser dimension than the base, or second head engaging portion of the hosel, when viewed perpendicularly to the striking faces.

6 Claims, 4 Drawing Sheets

19
18
13
2
24
17
15
14
25
16
11
18
19

12
24
17
32
25
16
-11-
31
14

12
16
24
25
31
17
-11-
15
32

19
13
2
24
17
25
16
-11-
14
19

GOLF PUTTER

This is a division of U.S. patent application Ser. No. 643,413, filed Jan. 18, 1991 now U.S. Pat. No. 5,116,054.

TECHNICAL FIELD OF THE INVENTION

This invention relates to a golf putter.

Golf putters usually comprise a blade type or a centre-shaft type. In a blade type putter the head includes a hosel located at one end of the blade for mounting the head on a shaft. In a centre-shaft type putter the hosel extends from the top of the blade but at a point intermediate the heel and toe and usually closer to the heel.

This invention relates to improved blade type putters.

BACKGROUND OF THE INVENTION

The putter is the golf club that should be used most in a round of golf. Half the strokes, or very nearly half the strokes are laid down for the putter in a regulation round of golf. It could be argued that the putter should therefore be the most precise club used by the golfer, and that all efforts should be made within the rules of golf to ensure that the putter provides optimum feel, and provides optimum ease of alignment for the golfer.

Reference is made to the "sweet spot" of the golf putter. The sweet spot of a golf club, or as in the present case a golf putter, is well known to those who are familiar with the game of golf. It is the area on a club face which should come in contact with the ball in order to give the greatest and straightest distance or flight to the ball and the best feeling.

The sweet spot is usually a relatively small area surrounding the intersection of a line normal to the ball striking face. Where the striking face has a loft angle the sweet spot is the small area surrounding the intersection of a straight horizontal line with the ball striking face. In a putter, there would not be much variation in the location of the sweet spot if a normal or straight horizontal line were considered because the loft angle is usually small and the periphery of the sweet spot tends to be ill defined. In a putter having right and left handed striking faces it follows that there are right and left handed sweet spots.

It is of great importance to the golfer to strike the ball at or very near the centre of the sweet spot; and particularly in the case of the putter, it is most important that the ball striking face of the putter head is at right angles to the selected line of the putt at the point of impact. This invention assists the golfer to achieve these aims.

One drawback with blade type putters is that it is difficult to align the axis of the shaft to pass through the centre or centroid of the sweet spot of the putter head because the hosel is located at one end of the blade.

There is another drawback with blade-type putters and this concerns additional costs of manufacture because different clubs needs to be manufactured for left and right handed players. Therefore separate patterns, separate dies, separate jigs, and separate tooling is required to manufacture most right hand and left hand blade type golf putters. This is because most blade type golf putters, which are distinct from centre-shaft type golf putters, are not symmetrical about their vertical toe to heel axial plane, and preferred embodiments of the invention overcome this problem.

Another drawback with current blade type golf putters is that they do not facilitate alignment of the putt. Some golfers tend to be distracted because of the shape of the back of the blade. The back of the blade may include a flange at the lower portion of the blade and/or a protruding shape or shapes that are not in line with the top edge of the ball striking face of the putter head which the golfer uses to square the putter to the intended line of the putt at impact. Preferred embodiments of the invention also overcome this drawback.

Further, a golfer may be distracted when lining up a putt, and when putting, by non-symmetrical and protruding hosels and heels of the putter head. Preferred embodiments of the invention also overcome this drawback.

A number of published patent specifications have dealt with the alignment of the axis of the shaft with the centre of gravity of the head or centre of percussion of the head, see for instance U.S. Pat. No. 2,926,913, Australian Patent Specification Nos. 466,553 and 449,540. These documents do not, however, address the manner in which those principles could be applied to a golf putter particularly a blade type of putter.

British Patent No. 14608 relates only to a single faced blade type putter with a configuration whereby the hosel basically extends from the heel of the blade without any stipulation regarding the axis of the shaft passing through the centre of a point in line and mid-distance between the centres or centroids of the sweet spots.

Other specifications such as British Patent No. 382046, U.S. Pat. Nos. 786,268 and 4,592,552 and Australian Patent Specification No. 79368/75 are concerned with the design of putters but none of them specifically addresses the problem of having a blade type putter in which the axis of the shaft is aligned with the centre of a point in line and mid-distance between the centers or centroids of the sweet spots.

STATEMENT OF THE ESSENTIAL FEATURES OF THE INVENTION

According to the present invention there is provided a blade type putter comprising a shaft, grip and putter head having a hosel which mounts the head on one end of the shaft, the putter being characterised in that the head includes two ball striking faces each having a sweet spot and the hosel is shaped such that the axis of the shaft bisects, substantially at a right angle, a straight line which passes through the centers or centroids of the sweet spots.

The invention also provides a blade type putter comprising a shaft, grip and putter head having two ball striking faces whereby the hosel extends upwardly from a top face of the blade adjacent to a heel end thereof, said hosel including a spigot for mounting the shaft, said head being characterized in that the hosel is shaped such that the axis of the shaft intersects the centre of a point in line at mid-distance between the centers or centroids of the sweet spots.

Preferably, the hosel of the putter head is so shaped to the top of the blade and extended to the heel of the putter head by a series of reverse curves which are symmetrical about the vertical toe to heel axial plane of the putter head such that the projected centre-line of the shaft intersects a point in line and mid-distance between the centre or centroid of the sweet spot on the right hand ball striking face of the putter head and the centre or centroid of the sweet spot on the left hand ball striking face of the putter head.

In use the golf putter of the invention gives exceptional feel to the golfer, because the putter is so designed that when the ball is struck at the centre of the sweet spot on either the right hand or the left hand ball striking face of the putter head, the projected centre-line of the shaft is directly behind the centre of the ball.

It is of great assistance to the golfer to find the sweet spot when putting the ball when the golfer knows that the projected centre-line of the shaft intersects a point in line and mid-distance between the centre of the sweet spots on the ball striking faces of the putter head.

The invention also provides a blade type putter comprising a shaft, grip and putter head having a hosel which mounts the head at one end of the shaft, the head including two striking faces, the putter being characterised in that the head includes a top face from which the hosel projects, and wherein the top of striking faces meet the top face of the head at top edges which are straight and extend substantially from the toe to the heel of the head and wherein the hosel includes a base which is elongate in the direction of said top edges and wherein said base merges into said top face by two concave, generally cylindrical surfaces the axes of which are parallel with said top edges.

Preferably, the hosel of the putter head is so shaped to the top of the blade of the putter head and extended to the heel of the putter head by a series of reverse curves which are symmetrical about the vertical toe to heel axial plane of the putter head as to form pronounced concave curves at the base of the hosel to the upper edge of both ball striking faces of the putter head that extend the two straight and parallel top edges of the ball striking faces from the toe of the putter blade along the full length of the base of the hosel to the heel of the putter head.

The generally cylindrical surfaces preferably have radii of curvature of about 3 mm and said cylindrical surfaces are reflective so that light reflected therefrom towards the user of the putter appears as lines which are parallel with the adjacent top edges of the putter blade and the top face of the putter blade and the cylindrical surfaces are polished.

The above defined head provides two distinctive straight and parallel edges at the top of the ball striking faces extending from the toe of the putter blade to the heel of the putter head and are clearly visible to the golfer, and assist the golfer to square the ball striking faces at right angles to the selected line of the putt at impact.

The reflected lines from the generally cylindrical concave surfaces at the base of the hosel parallel with the top edges of the ball striking faces further assist the golfer to square the ball striking faces at right angles to the selected line of the putt at impact.

Aforementioned U.S. Pat. No. 786,268 discloses a putter head which has two parallel lines at the top edge to assist the user in aligning the club head with the desired direction of the stroke. There is, however, no disclosure of concave cylindrical surfaces by which the base of the hosel merges into the top of the blade. Similarly, British Patent No. 14608 does not disclose cylindrical surfaces by which the base of the hosel merges into the top of the blade.

All visible surfaces of the hosel are preferably carefully shaped and rounded so as not to distract the view of the golfer from the two straight and parallel edges at the top of the ball striking faces of the putter head.

Distractions to the golfer at the back of the putter blade are minimised because, in the preferred embodiment, the back of the putter blade is the alternate hand ball striking face, and is a plane straight near vertical face, and the top edge of this face is a straight edge, parallel, and equidistant from the eye of the golfer when putting to the top edge of the ball striking face of the putter head, with both straight top edges of the ball striking faces extending clearly from the toe of the putter blade to the heel of the putter head.

Both ball striking faces of the putter head are flat within manufacturing tolerances, and the angle of loft of both ball striking faces are equal, and close to $4\frac{1}{4}°$. Both ball striking faces of the putter head are of equal dimensions, and extend from the toe of the putter blade to the heel of the putter head, and from the top of the putter blade to the chamfer at the sole of the putter head.

The putter is preferably symmetrical about the vertical toe to heel axial plane, and the putter has equal properties and has equal advantages right hand and left hand, and this putter can be used with equal effect when striking the ball with either the right hand ball striking face of the putter head or with the left hand ball striking face of the putter head, and this improved blade type golf putter can be used to equal effect by right handed and left handed golfers.

Because the putter is symmetrical about the vertical toe to heel axial plane, it will hang plumb in the toe to heel plane. Therefore the putter can be used as a plumb line by the golfer to assist the golfer to assess slopes on the putting surface, and to assist the golfer to determine the line of putts.

It is easier for the eye to square two long straight parallel lines at right angles to another line than to square two short straight parallel lines at right angles to another line, and the preferred shape of the head is such as to extend the clear view and the length of the two straight and parallel top edges of the ball striking faces of the putter head from the toe of the putter blade to the heel of the putter head. When putting either right hand or left hand, both top edges of the ball striking faces of the putter head appear as relatively long straight and parallel edges, not too far apart, and very clearly visible to the golfer with minimal distractions, thus assisting the golfer to square the ball striking faces of the putter head at right angles to the selected line of the putt at impact.

The top of the putter blade is preferably straight in side elevation, but is shaped convexly in end elevation and in cross-section so as to disperse and reduce reflected light, and the top of the putter blade is shaped to produce very clearly defined straight and parallel top edges at both ball striking faces of the putter head.

Preferably further, the toe of the putter head is so shaped at the end of the blade so as to appear to the golfer when putting as a clear sharp line at right angles (90°) to the two top edges of the ball striking faces of the putter head. This tends to accentuate the effect of the two straight and parallel top edges of the ball striking faces of the putter head to further assist the golfer in squaring the ball striking faces of the putter head to the selected line of the putt at impact. This is accomplished by extending the curve at the toe, as seen in side elevation, slightly past the vertical so that the user does not see the curved line at the toe end of the top surface due to the convex shape of the top surface.

The bottom or sole of the putter head is preferably flat in end elevation and in cross-section, and the sole of the putter head is at right angles to the vertical toe to heel axial plane of the putter head, but in side elevation the sole of the putter head is shaped in a very gentle curve at its base to give the centre-line of the putter shaft a lie of near 21½°, then the sole of the putter head is curved more steeply and accentuated towards the toe of the putter blade and the heel of the putter head. By careful application of these curves at the sole of the putter head, the putter will sit and feel comfortable to golfers who have a more conventional putting style, but the putter will also suit golfers with the most upright or least upright of putting styles.

The head preferably includes chamfers between the sole of the putter head and both ball striking faces are so shaped as to generally maintain a uniform width of the sole of the putter head from the toe of the putter blade to the heel of the putter head by changing the angle of the chamfers, and maintaining greater depth of the ball striking faces of the putter head below the sweat spots.

In the eventuality of non-approval of two ball striking faces by The Royal and Ancient Golf Club of St. Andrews, Scotland, or other regulatory body, a manufacturer's name, trade mark, and/or logo, or markings, would be included on one ball striking face of the putter head in such a manner so as to render that face unsuitable for striking the ball without affecting in any way any other features of the putter and the putter head would then have a leading striking face and a rear following face or back face of the blade of the putter head without departing from the spirit and scope of the invention. Accordingly, in this specification and claims the references to two striking faces should be construed to include arrangements in which the back face is rendered unsuitable for striking the ball.

DESCRIPTION OF THE INVENTION FROM THE DRAWINGS

Figures 1, 2, 3, 4:
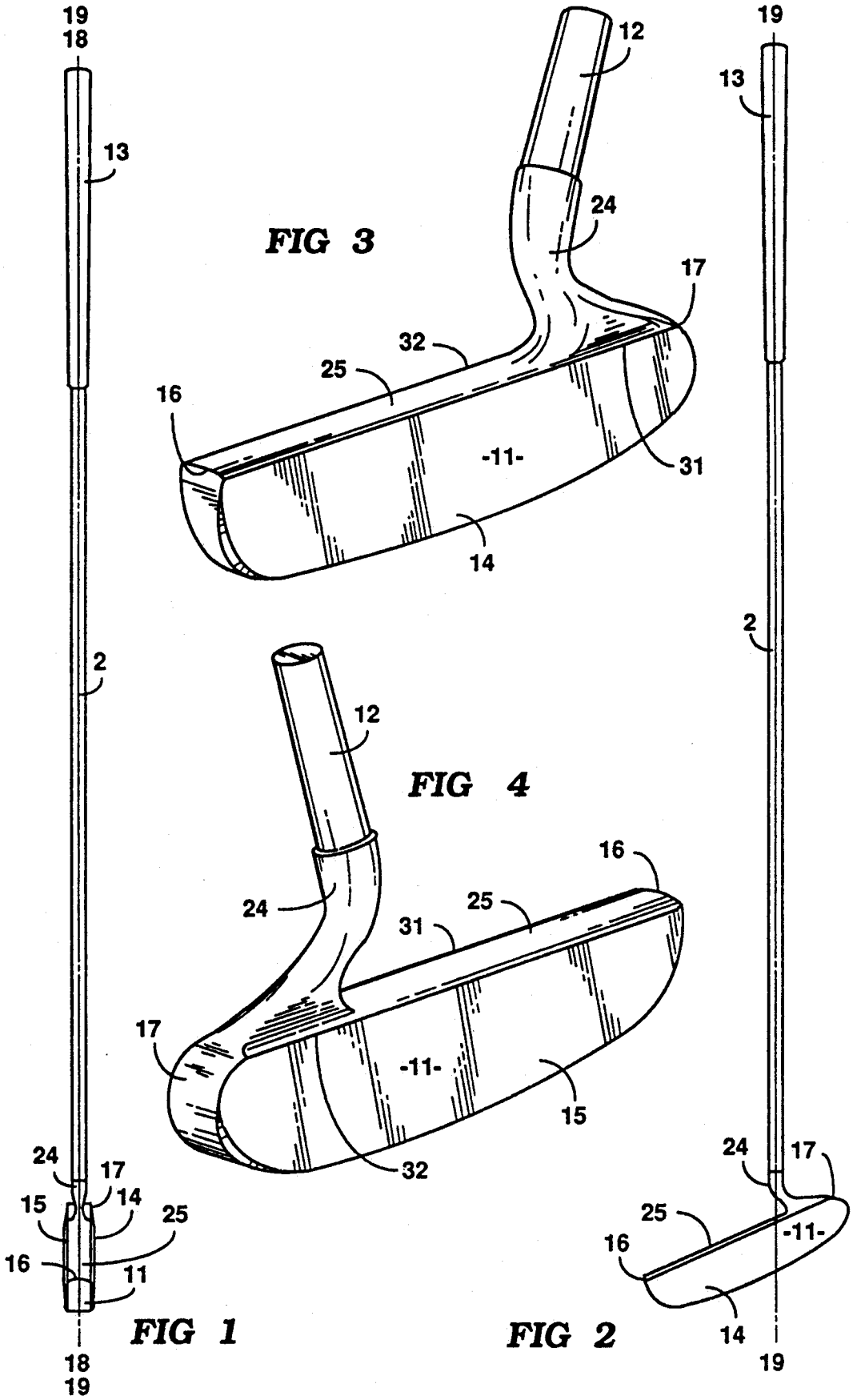
FIG. 1 shows the complete putter suspended vertically in the heel to toe axial plane.
FIG. 2 shows the complete right hand side elevation of the putter.
FIG. 3 is a front perspective view of the putter head.
FIG. 4 is a rear perspective view of the putter head.

The putter is shown in its complete form in FIGS. 1 and 2 and comprises in general a head 11, a shaft 2 and a grip 13.

The head 11 of the putter is a double faced blade type putter head having a right hand ball striking face 14, a left hand ball striking face 15 and a toe 16 and heel 17. Both ball striking faces 14 and 15 of the putter head 11 are of equal dimensions with equal angles of loft of close to 4¼°.

Figure 9:
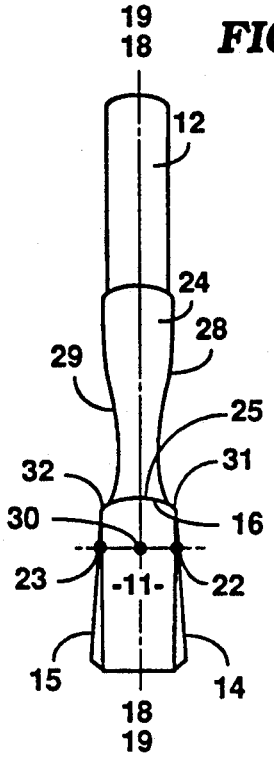
FIG. 9 is an end view looking at the toe of the putter head.
Figure 10:
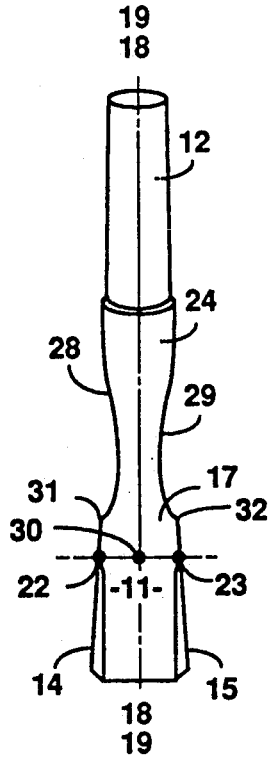
FIG. 10 is an end view looking at the heel of the putter head.

The right hand ball striking face 14 and the left hand ball striking face 15 of the putter head 11 are symmetrical about the toe to heel vertical axial plane 18—18 as shown in FIGS. 1, 7, 9 and 10. The centre-line and the projected centre-line 19—19 of the shaft 2 lies in the toe to heel vertical axial plane 18—18 as best seen in FIGS. 1, 9 and 10.

The putter head has right and left hand sweet spots 20 and 21 on the right and left hand striking faces 14 and 15 respectively. The sweet spots 20 and 21 have centres or centroids 22 and 23, as best seen in FIGS. 5, 6, 9 and 10. The centres 22 and 23 lie on a straight horizontal line having a mid point 30 of the head.

Figure 5:
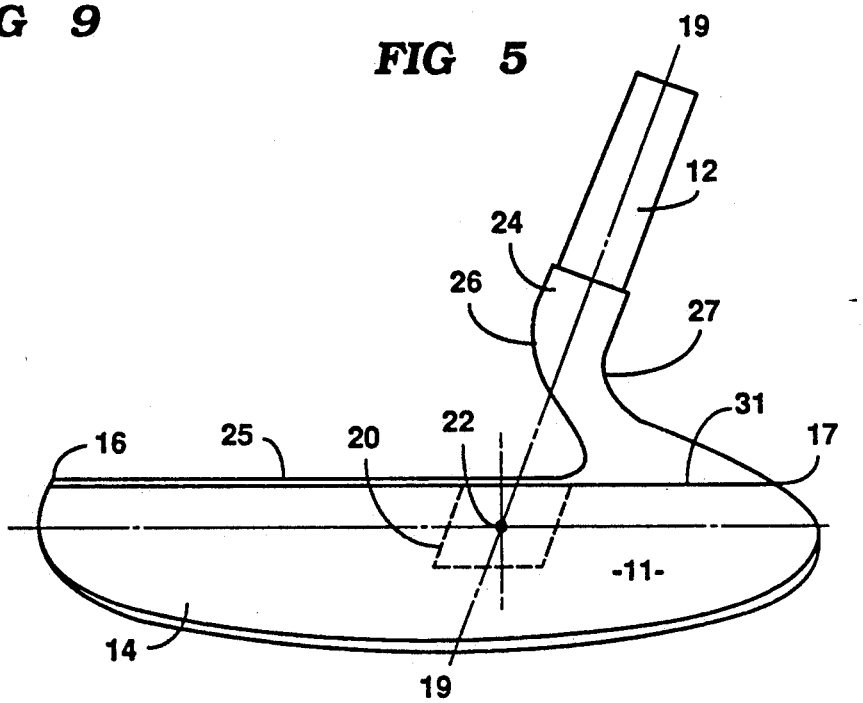
FIG. 5 is a right hand front elevation of the putter head showing the sweet spot on the right hand ball striking face of the putter head.
Figure 6:
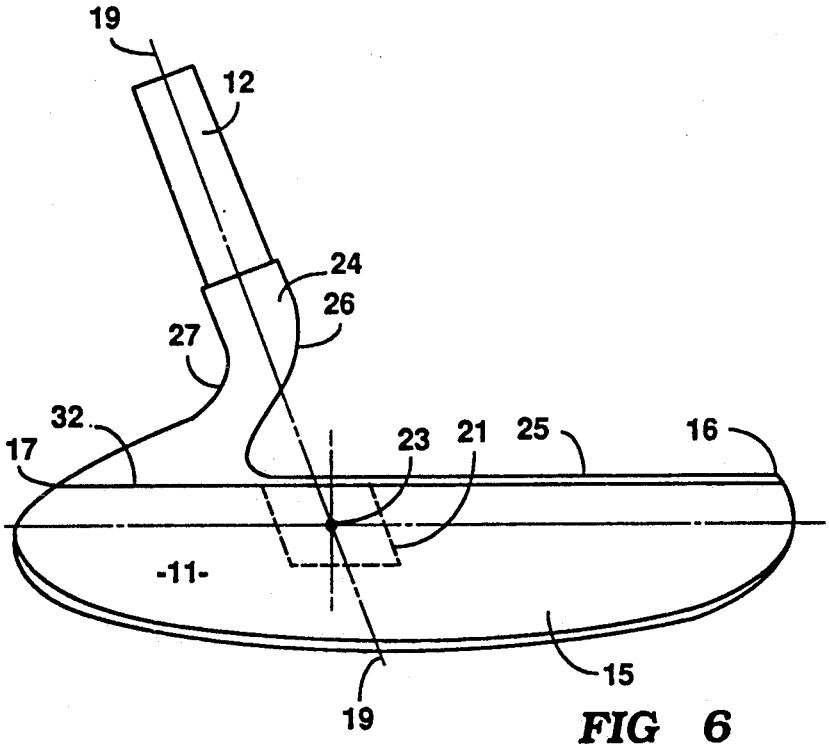
FIG. 6 is a left hand front elevation of the putter head showing the sweet spot on the left hand ball striking face of the putter head.
Figure 7:
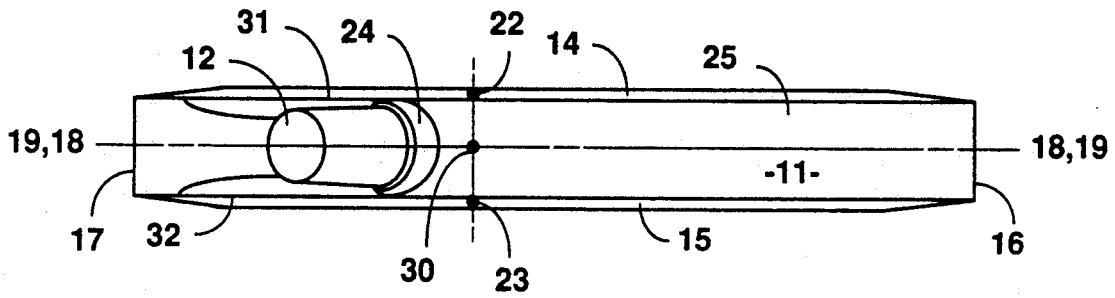
FIG. 7 is a plan view of the putter head.
Figure 8:
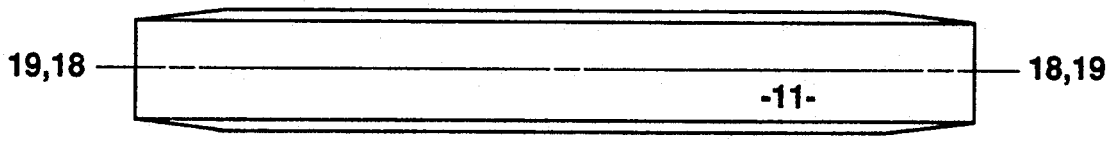
FIG. 8 is an underside view showing the sole of the putter head.

The head has hosel 24 which includes a spigot 12 which is located in a socket at the end of the shaft 2. A shoulder 7 is adjacent to the spigot 12 and abuts the lower end of the shaft 2. The hosel 24 projects from a convex top 25 of the blade. The top 25 intersects the tops of the striking faces at edges 31 and 32. The edges are straight, parallel and extend along substantially the full length of the blade. The hosel 24 includes reverse curves 26 and 27 as seen in side view. The curve 27 extends from the heel 17 of the putter head 11 to the end of the spigot 12 as shown in FIGS. 5 and 6. The shape of the reverse curves 26 and 27 is such that the projected centre-line 19—19 of the shaft 2 intersects the line passing through the centers or centroids of the sweet spots 20 and 21.

Figure 11:
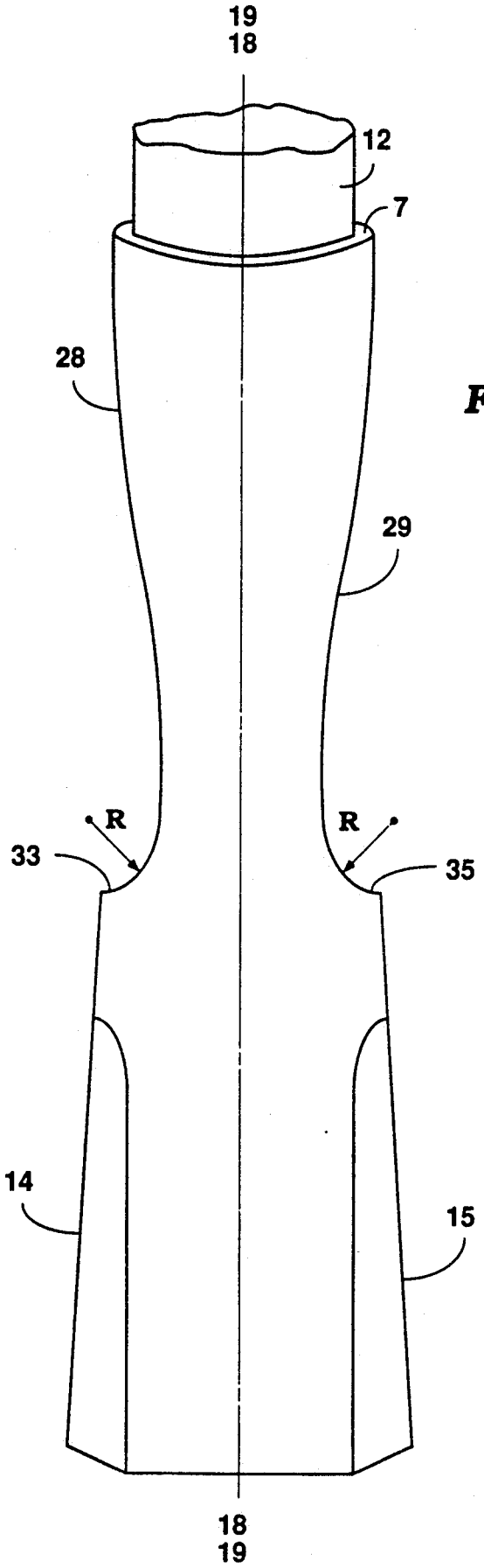
FIG. 11 is a similar view to FIG. 10 but on an enlarged scale.

As seen in end view, the hosel 24 also has reverse curves 28 and 29 which are symmetrical about the vertical toe to heel axial plane 18—18 of the putter head 11 as shown in FIGS. 9 and 10. The lower parts 33 and 35 of the curves 28 and 29 are of smaller radius of curvature than the upper parts and can be regarded as being of generally cylindrical shape with radius R, as indicated in FIG. 11. This enables the top edges 31 and 32 of the ball striking faces 14 and 15 to extend for substantially the full length of the blade. The provision of the curves 28 and 29 makes the hosel 24 narrower than the top 25 of the blade and therefore the user can have a substantially uninterrupted view of the edges 31 and 32. The extension of the straight and parallel top edges of the ball striking faces of the putter head from the toe of the blade of the putter head along the base of the hosel to the heel of the putter head greatly assists the golfer to square the ball striking faces of the putter head at right angles to the selected line of the putt at impact. As best seen in FIG. 6, the curve defining the toe is inclined slightly to the vertical (towards the shaft) where it meets the convex top 25. In use of the putter the user will thus see a straight end perpendicular to the edges 31 and 32 and this further assists in alignment of the putt.

Because the lower parts 33 and 35 have a concave cylindrical shape, light reflected therefrom towards the user appears as lines which are parallel with the edges 31 and 32 and extend generally speaking along the full length of the base of the hosel. This further assists the golfer to square the ball striking faces at right angles to the selected line of movement of the putter head. It is therefore preferred that at least the lower parts 33 and 35 are highly polished. Indeed the whole of the putter head may be polished.

This improved blade type golf putter is symmetrical about the vertical toe to heel axial plane of the putter head and can be used with equal effect by right and left handed golfers.

In the putter of the invention, if the blade has a length L, it is preferred that the length of the base of the hosel is approximately L÷3. It is further preferred that the shoulder 7 is spaced above the sole of the club by a distance of about L÷2. The height of the striking faces is generally about L÷5. The radius of curvature R of the cylindrical parts 33 and 35 is in the range from 1.5 mm to 4 mm and preferably about 3 mm. In the preferred embodiment, the length L of the blade is about 110 mm.

The illustrated putter head is designed to be compact, yet to appear to be long of blade to the golfer when putting. It also has a sleek attractive appearance.

The putter head 11 which includes the hosel 24 and the hosel spigot 12, can be manufactured from a copper alloy, steel alloy, aluminium, aluminium alloy, plastic, fiberglass, epoxy resin compound, ceramic, or any other material or compound that can be cast, die-cast, moulded, injection moulded, forged, extruded, fabricated, machined, or hand finished and can be manufactured in one or in any combination of these materials.

Many modifications will be apparent to those skilled in the art without departing from the spirit and scope of the invention.

I claim:

1. A blade type putter comprising a shaft having an axis and at one end thereof, a grip and a putter head having a hosel which mounts the head on one end of the shaft, the putter being characterized in that the head includes two oppositely facing ball striking faces each having a desired striking area having a center or centroid, said hosel having a first portion for attachment to said shaft wherein the shaft will be disposed so that the axis of the shaft intersects substantially at a right angle the midpoint of a straight line which passes through the centers or centroids of the desired striking areas, said hosel first portion being disposed above said top face and between the heel end of said putter head and the center of said putter head, said first portion being connected to said putter head by a second portion which is joined to said putter head top surface at an area extending from said heel end toward the center of said top surface but terminating short of a line through which the axis of the shaft extends, said second portion having a heel end part which extends inwardly toward the first part from the heel end and merges into the second portion in a concave curvilinear fashion and a second part which extends from the inner termination of said second portion and is curved rearwardly toward the heel end of the putter and then outwardly to merge into the first portion of the hosel so that the first portion of the hosel when viewed perpendicularly to the striking faces has a substantially lesser dimension than the base of the hosel where it is connected to said putter head top surface so that although the shaft axis intersects at a substantially right angle the midpoint of a straight line passing through the centers or centroids of the desired striking areas the second portion of the hosel does not encompass that area along the top face of the putter head so as to confine the area of the attachment of the shaft to the putter head in the area displaced toward the heel end of the putter head from the center or centroids of the desired striking areas.

2. A putter as claimed in claim 1 the tops of the striking faces meet said top face at edges which are straight and parallel and of substantially equal length.

3. A putter as claimed in claim 2 wherein said top face is a convex surface.

4. A putter as claimed in claim 1 wherein the putter head has a length L and the base of the hosel has a length of approximately L÷3.

5. A putter as claimed in claim 4 wherein the hosel includes a spigot which extends into the lower end of the shaft and a shoulder which abuts the lower end of the shaft, and wherein the shoulder is located above the sole of the blade by a distance of approximately L÷2.

6. A putter as claimed in claim 5 wherein the vertical height of the striking faces is approximately L÷4.

* * * * *